US006513207B2

(12) United States Patent
Uehara et al.

(10) Patent No.: US 6,513,207 B2
(45) Date of Patent: Feb. 4, 2003

(54) BELT CONNECTING DEVICE

(75) Inventors: Ryoichiro Uehara, Toyama-ken (JP); Tomohisa Ishida, Saitama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/961,440

(22) Filed: Sep. 25, 2001

(65) Prior Publication Data

US 2002/0040516 A1 Apr. 11, 2002

(30) Foreign Application Priority Data

Sep. 26, 2000 (JP) ..... 2000-291639

(51) Int. Cl.[7] ..... A44B 11/26; A45C 13/30
(52) U.S. Cl. ..... 24/615; 24/633; 24/629
(58) Field of Search ..... 24/614, 615, 616, 24/171, 196, 625, 629, 659, 633, 644

(56) References Cited

U.S. PATENT DOCUMENTS 1,225,710 A * 5/1917 Herschede ..... 24/630 X
1,495,118 A * 5/1924 Starck ..... 24/630
2,612,139 A * 9/1952 Collins ..... 24/681 X
3,885,811 A * 5/1975 Takada ..... 24/628 X
4,665,596 A * 5/1987 Green ..... 24/662
5,443,039 A * 8/1995 Suchowski ..... 24/625 X
5,485,658 A * 1/1996 Fildan ..... 24/614

* cited by examiner

*Primary Examiner*—Robert J. Sandy
(74) *Attorney, Agent, or Firm*—Finnegan, Henderson, Farabow, Garrett & Dunner, L.L.P.

(57) ABSTRACT

A belt connecting device having a female member and male member engagable with each other; an engaged/disengaged portion of the female member having a substantially U-shaped pinching resilient portion open at a side of a belt connecting portion, having a narrow portion in the middle thereof, and extending substantially on one plane from the other end; an engaging/disengaging portion of the male member having a protruded portion projecting substantially from a rear middle portion of said plate shaped body and at least a belt connecting portion side end face portion thereof having a configuration to be circumscribed by a pinching surface of the pinching resilient portion of the female member; and a substantially C-shaped attachment flange, having a gradually increasing projection, whose rear face engages with a surface attachment face of the pinching resilient portion at an upper end of the protruded portion.

6 Claims, 6 Drawing Sheets

BELT CONNECTING DEVICE

BACKGROUND OF THE INVENTION

1. Field of the Invention

The present invention relates to a belt connecting device attached at ends of belts such as belt, cord or the like, for connecting these ends with each other. The belts shall be called simply "belt" in the specification.

2. Description of the Related Art

Conventionally, various engagement and disengagement structures for this kind of belt connecting device have been disclosed in, for example, Japanese Utility Model Publication Nos. 62-36814, 5-35699, and 7-95, Japanese Utility Model Laid-open Publication No. 7-34706 and the like.

In these proposals, an engaging/disengaging portion of any male engaging/disengaging member has a disk shape flange around an axial line of a post protrusion projecting from one surface of a plate shaped member at the tip of the post protrusion, and this engaging/disengaging portion engages with and disengages from an engaged/disengaged portion of a female member. The engaged/disengaged portion is formed on a tongue piece extending from a body of the female member, is composed of a part of a long hole opening at one end of the tongue piece and has a structure for guiding in slide contact side faces of the post protrusion of the male engaging/disengaging member and for engaging a rear face of the flange by contact with the engaged face of the surface thereof.

Therefore, the engagement operation of the male member and the female member is performed by inserting a protrusion section of the male member from an open insertion slot of the long hole of the female member, in a way to approach both ends of a belt each other, and thereafter, by pulling both belt ends in the separation direction to engage with each other. And the disengagement operation thereof is performed by pulling out the protrusion section of the male member from the long open insertion slot of the female member, in a way to approach both ends of the belt each other.

Thus, in the engagement and disengagement operation of the aforementioned belt connecting device, a relative displacement operation of the male member and the female member in a way to pulling or approaching the belt ends toward each other along the belt connection direction in both cases must be performed intentionally, thereby making the engagement and disengagement operation complicated.

In addition, for example, when the male member and the female member are in engagement, the mutual engagement tends to be released easily when the belt is slack, and can not be disengaged easily in a case when the belt can not be loosened in a state where the belt is stretched.

SUMMARY OF THE INVENTION

The present invention is devised to solve such conventional problems and an object of the invention is to provide a belt connecting device facilitating the engagement and disengagement operation of a male member and a female member and not only facilitating the disengagement even when the belt is stretched, but also preventing easy disengagement when the belt is slack.

A main aspect of the present invention provides a belt connecting device composed of a female member and a male member which can engage with and disengage from each other, and the female member has an annular body and has a belt connecting portion at one end thereof and an engaged/disengaged portion for engaging with and disengaging from the male member at the middle of the other end thereof, while the male member has a plate shaped body and has a belt connecting portion at one end thereof and has an engaging/disengaging portion for engaging with and disengaging from the engaged/disengaged portion of the female member at a middle portion thereof. The engaged/disengaged portion of the female member is composed of a substantially U-shaped pinching resilient portion open at the belt connecting portion and extending substantially on one plane from the other end. The engaging/disengaging portion of the male member includes a protruded portion projecting substantially from a rear side middle portion of the plate shaped body and at least the end face portion of the belt connecting portion side having a configuration to be circumscribed by a pinching surface of the pinching resilient portion of the female member, and a substantially C-shaped attachment flange a rear face of which engages with a surface attachment face of the pinching resilient portion at an upper end of the protruded portion. And the attachment flange has a projection amount gradually increasing from the protruded section in a direction toward the belt connecting portion of the male member.

In this invention, the protruded portion to be formed on the engaging/disengaging portion of the male member has the configuration to be circumscribed by the pinching face of the pinching resilient portion of the female member and the projection amount of the attachment flange to be formed at the top end of the protruded portion from the protruded portion is increased gradually in a direction toward the belt connecting portion of the male member. Therefore, when the female member and the male member are to be engaged, the end face portion of the belt connecting device side of the protruded portion is fitted to the pinching face of the pinching resilient portion, and at the same time, the attachment flange attaches with the surface attachment face of the pinching resilient portion to be engaged firmly.

Also, when the female member and the male member are to be disengaged, both members can be disengaged easily by rotating so as to lift an end opposite to the belt connecting side of the female member with fingers, allowing to move in a way to disengage gradually from the attachment face of the pinching resilient portion from the flange portion with small protrusion amount of the attachment flange to the flange portion with large protrusion amount.

Preferably, the pinching resilient portion has a guide space for guiding the engaging/disengaging portion, enlarged gradually toward the belt connecting portion side, and an arc shaped pinching space adjacent to the guide space. The structure of such pinching resilient portion ensures a smooth insertion and extraction operation of the engaging/disengaging portion of the male member in respect to the pinching resilient portion of the female member, for engaging with and disengaging from the male member. Moreover, in combination with the foregoing features of the invention of the main aspect, it is possible to perform the engagement/disengagement securely and easily.

Further preferably, the protruded portion of the male member has a substantially U-shape opening toward an end opposite to the belt connecting portion in a plan view, an end at the side of the belt connecting portion has an arc shape outer surface fitting with the pinching space, and a projection height of legs extending to a side away from the belt connecting portion at least at a connecting portion with the flange has the same height as a top face of the flange.

A dimension between outer sides of the pair of right and left legs are set approximately equal to the right and left width dimension of a connection area between the guide space and the pinching space of the aforementioned pinching resilient portion. Since the protruded portion is not a simple column but has a leg outside face adjacent to a cylindrical outer surface, when the female member and the male member are engaged, both members do not rotate relatively around the protruded portion, allowing to perform smoothly the insertion and extraction operation of the male engaging/disengaging portion in respect to the pinching resilient portion.

Preferably, a pair of respective resilient legs extending to the belt connecting portion side of the pinching resilient portion have long holes extending longitudinally in middle portions thereof. The formation of the long holes ensures the strength of the resilient legs and facilitates the elastic deformation in the right and left direction, making it easy to engage/disengage the female member with/from the male member.

Further preferably, top faces of the resilient legs have a plane extending in parallel to a rear side of the annular body toward the belt connecting portion, and a taper face inclined downward toward a tip end adjacent to the plane.

With such structure, if the end of the male member at the side opposite to the belt connecting portion is rotated in a direction for separating the male member from the female member around the end of the belt connecting portion side, the attachment flange of the male engaging/disengaging portion inclines relatively in respect to the female member, the flange portion of a belt fixing rod side where the projection amount is maximum moves in a direction away from the arc shape pinching face of the pinching resilient portion of the female member and moves, being guided consecutively along the taper face formed on the top face of the resilient leg of the female member, from the flange portion of the right and left leg side with the minimum projection amount to the flange portion with the maximum projection amount.

The guide space of the insertion/extraction slot area where this taper face is set larger than the maximum right and left width of the attachment flange, the attachment flange shifts consecutively to the guide space from a portion where the projection amount is small to a portion where the projection amount is large, thereby disengaging automatically the female member and the male member.

Consequently, according to the present invention, when the female member and the male member are to be disengaged, it is unnecessary to move the female member and the male member intentionally to approach each other, and they can be disengaged simply by performing the rotation operation in the direction to separate one end of the male member from the female member taking the belt connecting portion as fulcrum.

Preferably, the thickness of a part of the belt connecting portion of the male member or female member is increased to an engaging/disengaging face side substantially by an entire thickness of the mating member. When both members engage in a superposed state, no step will be generated in the whole, and the appearance will be attractive, by making the belt connecting portion side end of one of the male member or the female member locally have a predetermined thickness, as mentioned above.

DESCRIPTION OF THE PREFERRED EMBODIMENT

Figure 1:
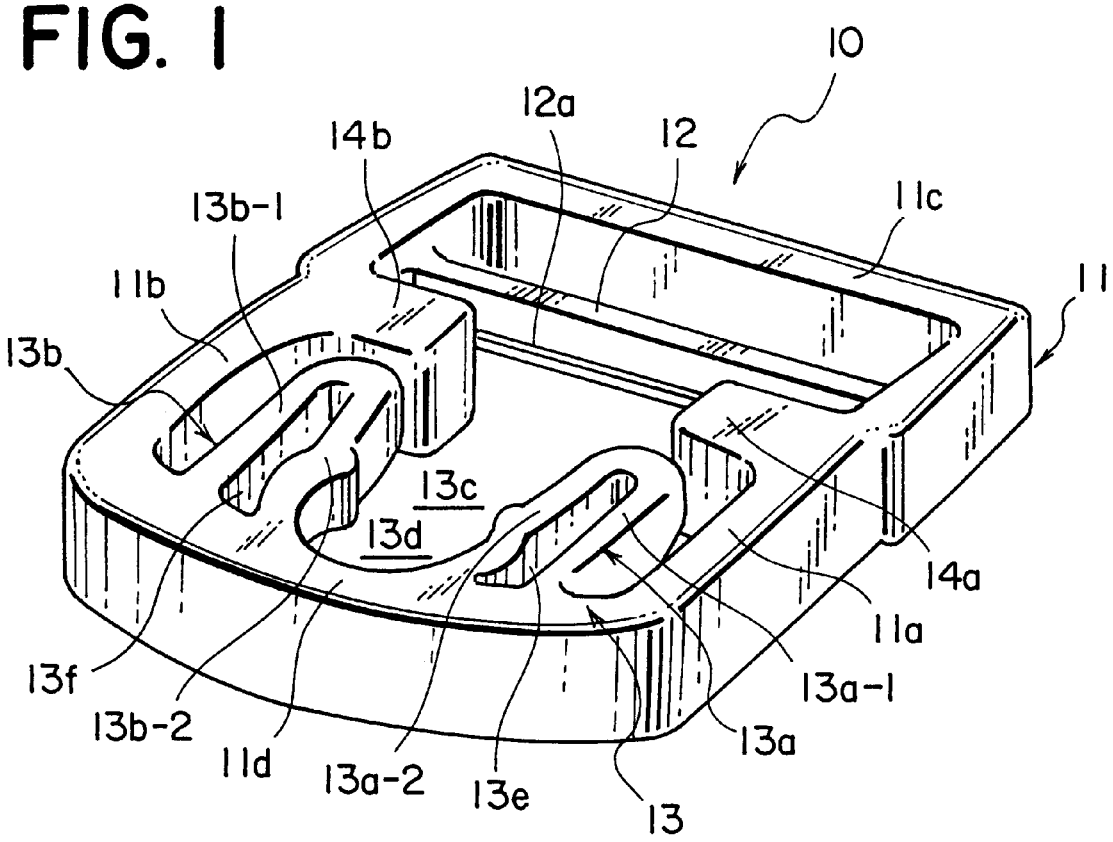
FIG. 1 is a perspective view showing the appearance of a representative embodiment of a female member of a belt connecting device according to the present invention.

Now, representative embodiments of the present invention will be described more specifically referring to the drawings.

Figure 2:
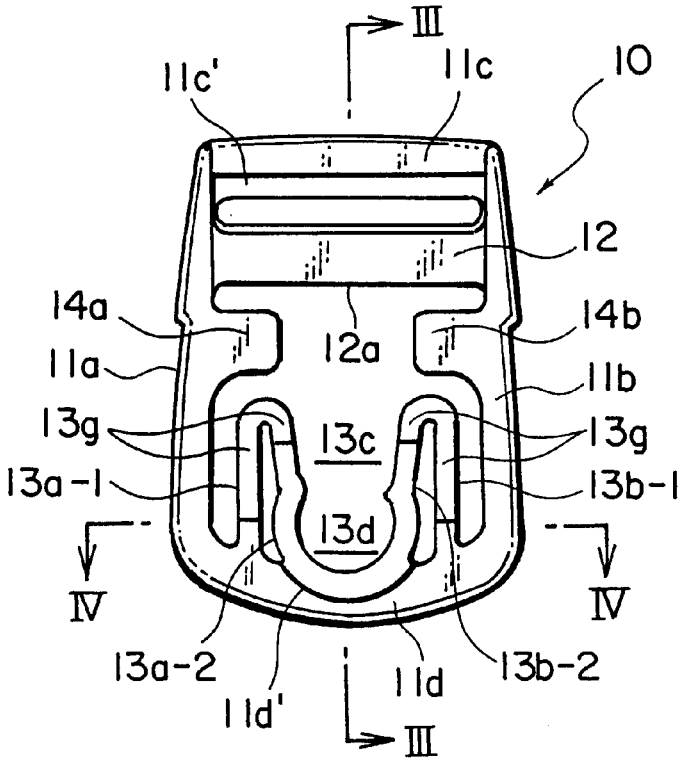
FIG. 2 is a rear view of the same female member.
Figure 3:
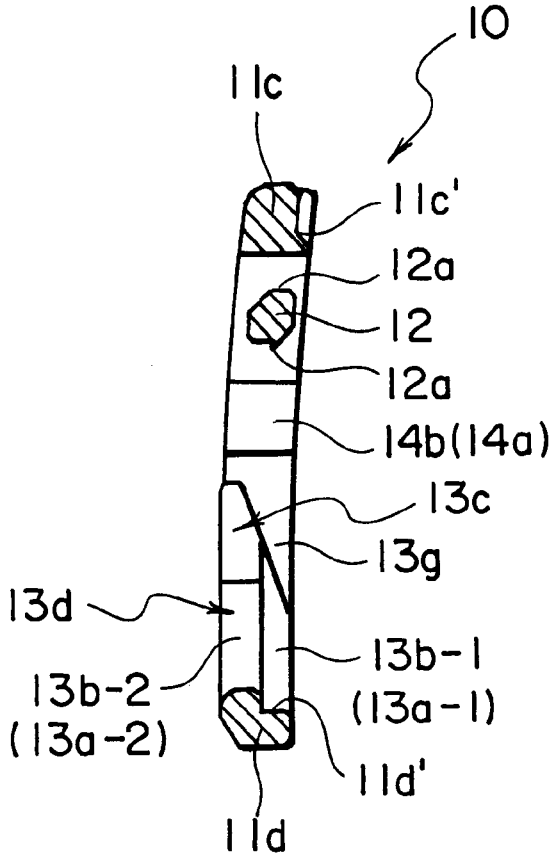
FIG. 3 is a cross-sectional view taken along the line III—III in FIG. 2.
Figure 4:
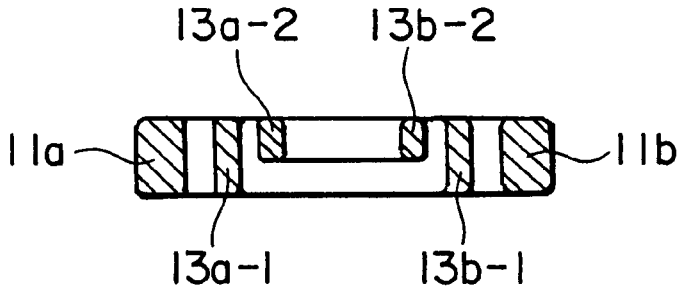
FIG. 4 is a cross-sectional view taken along the line IV—IV in FIG. 2.

FIG. 1 to FIG. 4 show a structure of a female member applied to an embodiment of a belt connecting device according to the present invention. FIG. 1 is a perspective view showing the appearance of the same female member, FIG. 2 is a rear view of the same female member, FIG. 3 is a cross-sectional view taken along the line III—III in FIG. 2, and FIG. 4 is also a cross-sectional view taken along the line IV—IV.

A female member 10 comprises an annular body 11 of substantially rectangular shape as the whole, a belt fixing rod 12 laid in a transverse direction through a belt insertion space at one end in a longitudinal direction of the female member 10, a pinching resilient portion 13 formed substantially in the half at the other end side in the longitudinal direction of the female member 10, and right and left protruded pieces 14*a*, 14*b* protruding in the opposition directions from right and left frames 11*a*, 11*b* between the belt fixing rod 12 and the pinching resilient portion 13.

On a belt connection side frame 11*c* of the annular body 11, a wedge shaped projecting portion 11*c*' is formed as shown in FIG. 3 in a width direction of the rear face thereof. Also, on a pinching resilient portion side frame 11*d* of the same annular body 11, an arc shaped recess 11*d*' for a close engagement with a part of an engaging/disengaging portion 22, mentioned below, of the male member 20 is formed as shown in FIG. 3, on the rear face of the middle portion in the width direction thereof. The belt fixing rod 12 is substantially diamond in section as shown in FIG. 3, and a projecting piece 12*a* having a wedge shaped section protrudes from opposite ridge portions thereof.

The pinching resilient portion 13 has, as shown in FIG. 1 and FIG. 2, a pair of right and left resilient legs 13*a*, 13*b* extending toward the belt fixing rod 12 from right and left sharing a part of the pinching resilient portion side frame 11*d* and has a substantially U shape as the whole including a part of the pinching resilient portion side frame 11*d*. A guide space 13*c* for guiding the male engaging/disengaging portion 22 at the side of the belt fixing rod 12 between the opposed faces of the resilient legs 13*a*, 13*b* and a pinching space 13*d* for the male engaging/disengaging portion 22 at the side of the pinching resilient portion side frame 11*d* continuous to the guide space 13*c*.

The guide space 13*c* increases its width between the opposed resilient legs 13*a*, 13*b* gradually toward the belt fixing rod 12 side, thereby making the space at the open end thereof large enough to insert the male engaging/disengaging portion 22. Moreover, the space portion of the guide space 13*c* communicating with the pinching space 13*d* is made to be slightly narrower than a diameter of an arc face which is an insertion side end face of a protruded portion 24 mentioned below of the male engaging/disengaging portion 22. Meanwhile, the pinching space 13*d* is made of a cylindrical space excluding a connection portion with the guide space 13*c*, and a diameter thereof is set to substantially equal to the diameter of the protruded portion 24.

Moreover, long holes 13*e*, 13*f* extending respectively in the longitudinal direction are formed through the middle of respective resilient legs 13*a*, 13*b*. The presence of this long hole 13*e*, 13*f* facilitates the elastic deformation of the resilient legs 13*a*, 13*b* in the opposed direction. Substantially half of rear faces of the resilient legs 13*a*, 13*b* at the belt fixing rod 12 side are made as taper faces 13*g* whose thickness in a height direction is reduced gradually toward the fixing rod 12, while the thickness at the side opposite to the fixing rod 12 of the resilient leg portions 13*a*-1, 13*b*-1 positioned outside of the long holes 13*e*, 13*f* of respective resilient legs 13*a*, 13*b* is made equal to the thickness of the annular body 11.

Further, a thickness in the height direction of resilient leg portions 13*a*-2, 13*b*-2 positioned inside of the long holes 13*e*, 13*f* of the resilient legs 13*a*, 13*b* is made identical for substantially the full length, and this thickness is substantially ½ of the resilient leg portions 13*a*-1, 13*b*-1 positioned outside, and top faces of the resilient leg portions 13*a*-2, 13*b*-2 are made flush with the bottom face of the arc shaped recess 11*d*' formed on the aforementioned pinching resilient portion side frame 11*d*. The taper face 13*g* is formed continuously on the surface of the resilient leg portions 13*a*-1, 13*b*-1 and 13*a*-2, 13*b*-2 positioned inside and outside with each other, therefore, the taper face 13*g* of the inside resilient leg portions 13*a*-2, 13*b*-2 with lower height is formed on the surface only at the end of the belt fixing rod 12.

Figure 5:
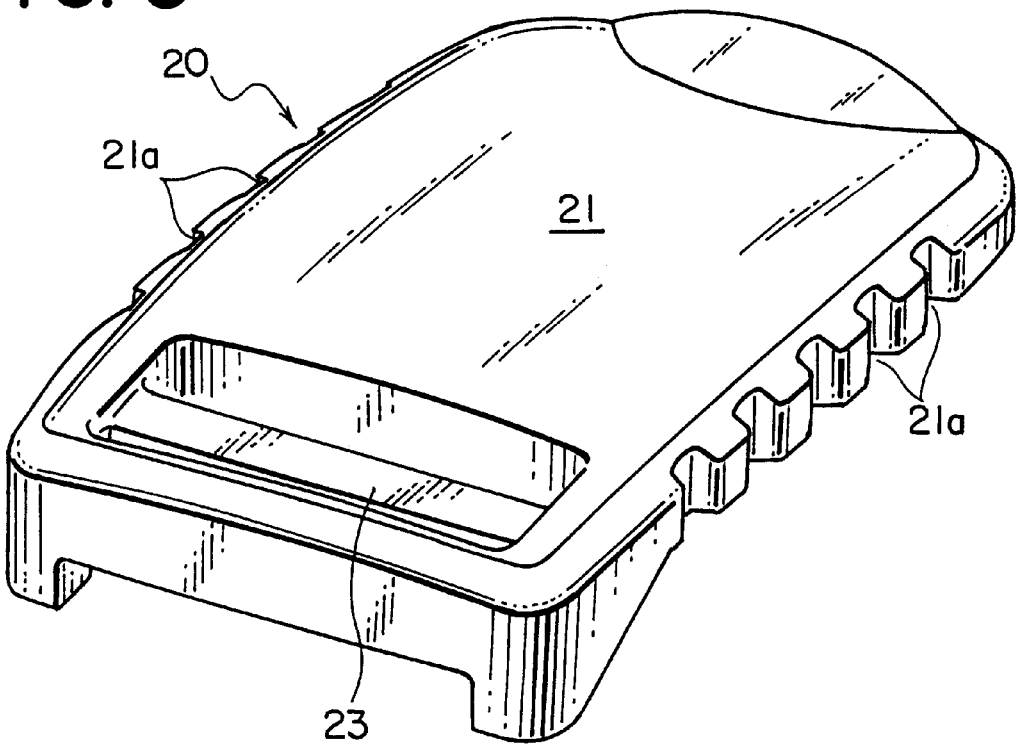
FIG. 5 is a perspective view showing the appearance of a representative embodiment of a male member of the belt connecting device according to the present invention.
Figure 6:
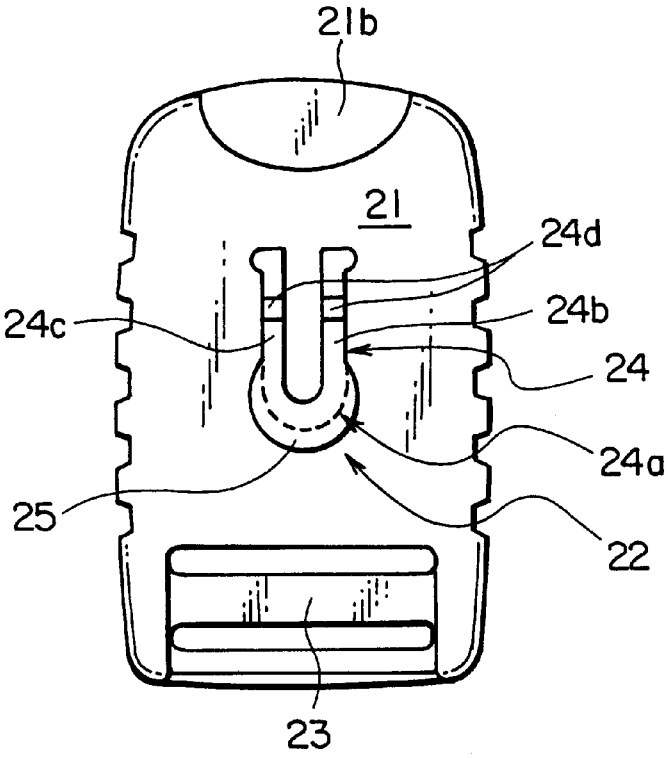
FIG. 6 is a rear view of the same male member.
Figure 7:
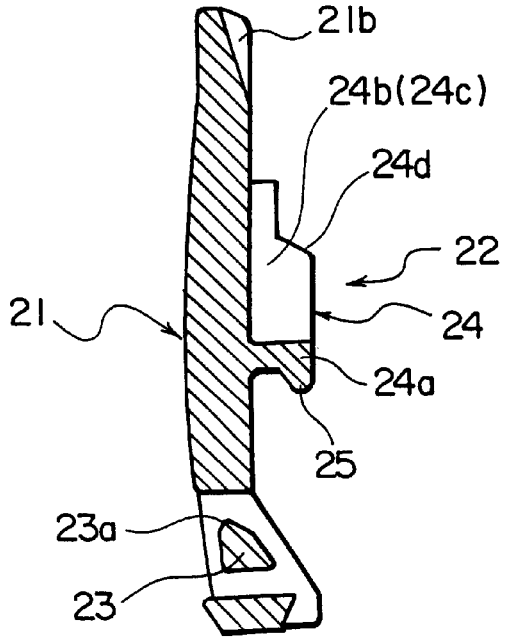
FIG. 7 is a longitudinal cross-sectional view of the same male member.

FIG. 5 to FIG. 7 show an example of the structure of a male member engaging with/disengaging from the aforementioned female member 10. FIG. 5 is a perspective view showing the appearance of the male member, FIG. 6 is a rear view of the same, and FIG. 7 is a longitudinal cross-sectional view of the same.

The male member 20 is composed of a substantially rectangular plate shaped body 21 and the male engaging/disengaging portion 22 protruding from substantially a middle portion of a rear face of the plate shaped body 21, and a belt fixing rod 23 is laid in the transverse direction through the belt insertion space at one end of the plate shaped body 21.

A plurality of recesses 21*a* are formed with a predetermined pitch, at a middle portion of right and left edges in the width direction of the plate shaped body 21, composing an uneven face for slip prevention. Moreover, a finger insertion recess 21*b* is formed on a rear face of an end at the side opposite to the belt fixing rod 23 of the plate shaped body 21. Further, according to this embodiment, both right and left ends of the belt fixing rod 23 side of the plate shaped body 21 is protruded to the rear face side by the thickness corresponding to the annular body 11 of the female member 10 of a counterpart. The belt fixing rod 23 has a substantially triangular cross-section, and a projecting pawl 23*a* having a wedge shape cross-section extends along a ridge portion of one side of the belt fixing rod 23.

On the other hand, as shown in FIG. 6 and FIG. 7, the aforementioned male engaging/disengaging portion 22 protrudes from a substantially middle portion surface of the plate shaped body 21 and has a substantially U shape when viewed from the rear side and has a protrusion shape with taper steps when viewed from the side. This male engaging/disengaging portion 22 has the protruded portion 24 which has a semi cylindrical portion 24*a* whose belt fixing rod 23 side end face portion is circumscribed by the inside pinching surface of the aforementioned resilient legs 13*a*, 13*b* of the female member 10, and right and left legs 24*b*, 24*c* extending in parallel continuously from the semi cylindrical portion 24*a* to the side opposite to the belt fixing rod 23, and a substantially C shaped attachment flange 25 at an top end of the protruded portion 24.

As shown in FIG. 7, the right and left legs 24*b*, 24*c* lower toward the side opposite to the belt fixing rod side respectively through a taper step portion 24*d* and the top face of a high portion continuous to the attachment flange 25 is flush with a top face of the attachment flange 25.

The attachment flange 25 has an elongated substantially C shape with a diameter increasing gradually from an axial center of the semi cylindrical portion 24*a* of the protruded portion 24 in a direction toward the belt fixing rod 23 of the male member 20. Consequently, the projecting amount of the attachment flange 25 protruding outside from the semi cylindrical portion 24*a* shown by the broken line in FIG. 6, increases gradually towards the belt fixing rod 23.

Figure 8:
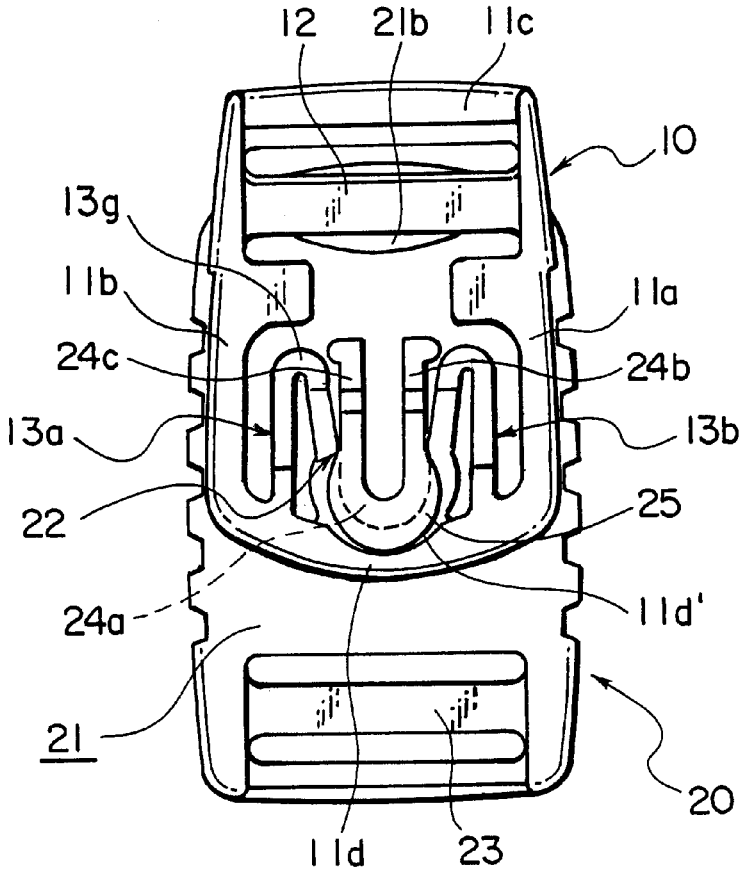
FIG. 8 is a rear view showing an engagement state of the female member and the male member according to this embodiment.
Figure 9:
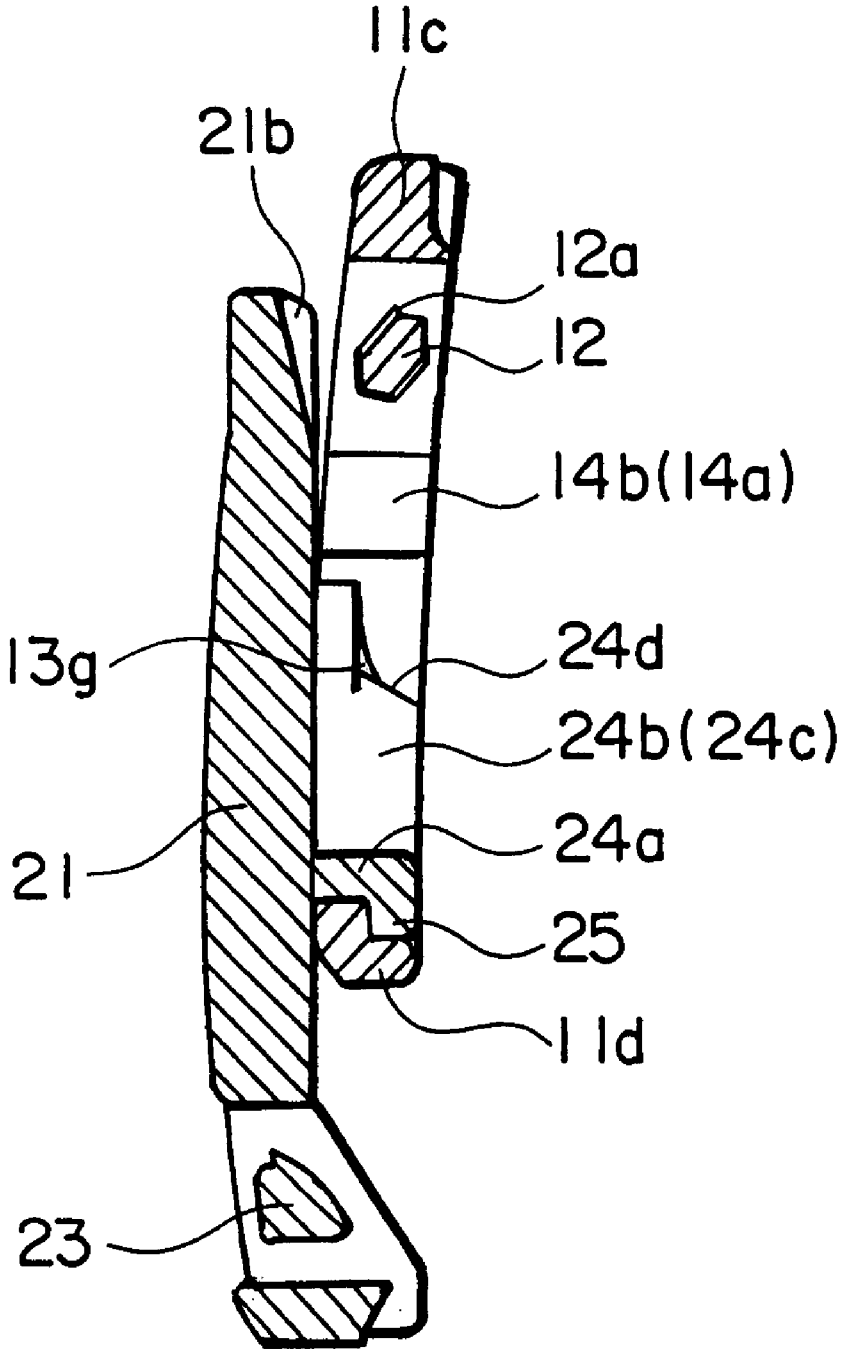
FIG. 9 is a longitudinal cross-sectional view of FIG. 8.

FIG. 8 and FIG. 9 show an engagement state of the female member 10 and the male member 20 according to the embodiment structured as mentioned above. FIG. 8 is a plan view showing the engagement state from the rear side, while FIG. 9 is a longitudinal cross-sectional view of the same.

Now, when the female member 10 and the male member 20 are to be engaged, the rear side of the male member 20 is opposed to the surface side of the female member 10, and the male engaging/disengaging portion 22 of the male member 20 is inserted into a space portion formed between the male engaging/disengaging portion insertion end of resilient legs 13*a*, 13*b* and the right and left protruded pieces 14*a*, 14*b* projecting from the right and left frames 11*a*, 11*b* of the female member 10, until the rear side of the plate shaped body 21 of the male member 20 comes into contact with the surface of the annular body 11 of the female member 10.

Then, the female member 10 and the male member 20 are moved in a direction of separation. During this movement, the protruded portion 24 of the engaging/disengaging portion 22 is guided in the guide space 13*c* of the resilient legs 13*a*, 13*b* of the female member 10 and expands the right and left resilient legs 13*a*, 13*b* to the right and left elastically in a narrow width portion between the guide space 13*c* and the pinching space 13*d*, and fits in the pinching space 13*d*. During this movement, at the same time, the rear face of the aforementioned attachment flange 25 is guided by the taper face 13*g* of the male engaging/disengaging portion insertion end side of the right and left inside resilient leg portions 13*a*-2, 13*b*-2, and thereafter, moved on the top face thereof by slide guiding, and when the protruded portion 24 of the engaging/disengaging portion 22 is fit in the pinching space 13*d*, the tip portion where the protrusion amount of the attachment flange 25 is the largest fits with the arc shaped recess 11*d*' formed on the pinching resilient portion side frame 11*d* of the female member 10, while the other flange portion engages firmly in a state being attached to the top face of the inside resilient leg portions 13*a*-2, 13*b*-2.

In order to disengage the female member 10 and the male member 20, it is unnecessary to move the female member 10 and the male member 20 in a direction toward each other intentionally, but it is enough to simply insert a finger in the finger insertion recess 21*b* provided on the rear side of the free end of the plate shaped body 21 of the male member 20, and to perform the rotation operation in a direction of separating from the female member 10 taking an end of the male member 20 at the side of the belt fixing rod 23 as fulcrum.

In short, when a finger is inserted in the finger insertion recess 21*b* and the male member 20 is rotated in the direction separating from the female member 10, the attachment flange 25 of the male engaging/disengaging portion 22 is inclined relatively in respect to the female member 10, the flange portion of the maximum projection amount separates from the arc shaped recess 11*d*' of the female member 10 and moves as being sequentially guided on the taper face 13*g* of the inside resilient leg portions 13*a*-2, 13*b*-2, from the flange portion of the minimum projection amount at the right and left legs 24*b*, 24*c* side to the flange portion of maximum projection amount at the belt fixing rod 23 side via the taper face 13*g* of the outside resilient leg portions 13*a*-1, 13*b*-1 of the female member 10.

Since the guide space 13*c* of an exit portion of the resilient legs 13*a*, 13*b* where this taper face is formed to be set larger than the right and left width of the attachment flange 25, the attachment flange 25 displaces consecutively into the guide space 13*c* from the portion of small projection amount to the portion of larger projection amount, disengaging the female member 10 and the male member 20.

It should be appreciated that, in this embodiment, the protruded portion 24 of the male engaging/disengaging portion 22 is composed of the semi-cylindrical portion 24*a*, and the right and left legs 24*b*, 24*c* adjacent to them, as mentioned above, and not of a simple column-shaped projecting portion having a disk like flange at an top end, the right and left resilient legs 13*a*, 13*b* of the female member 10 and the right and left legs 24*b*, 24*c* of the male member 20 move relatively in the engaged state during the engagement and disengagement operation of the male member 20 in respect of the female member 10, and no relative rotation is generated between the female member 10 and the male member 20 as in the case of being simply a column shape protruded portion.

Figure 10:
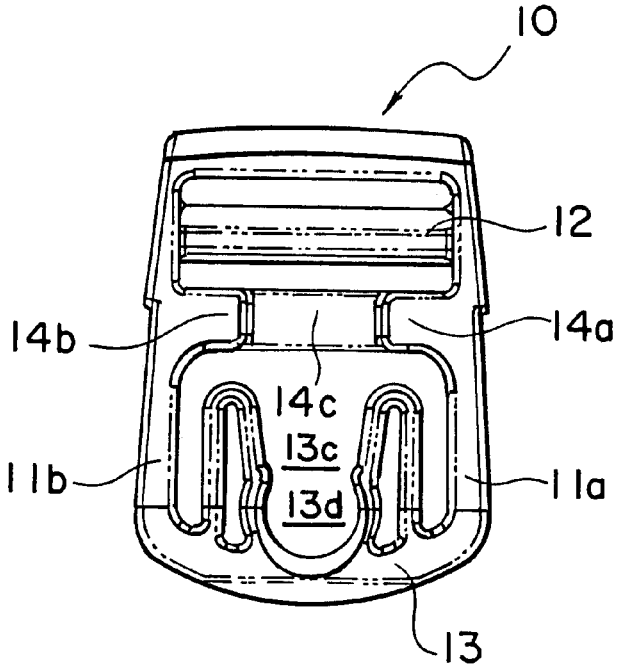
FIG. 10 is a rear view of a female member according to a modification of the invention.
Figure 11:
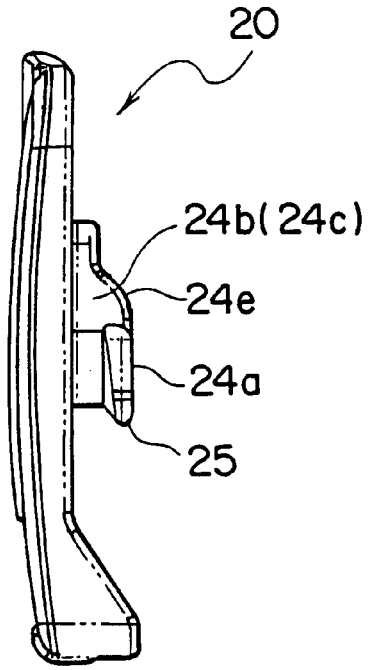
FIG. 11 is a side view of a male member according to a modification of the invention.

FIG. 10 and FIG. 11 show modifications of the invention, and FIG. 10 is a rear view of the female member 10 and FIG. 11 is a side view of the male member 20.

The female member 10 shown in FIGS. 5 to 7 has the pinching resilient portion 13 formed substantially in the half at the side thereof opposite to the belt fixing rod 12 in the longitudinal direction of the female member 10, and the right and left protruded pieces 14*a*, 14*b* protruding in the opposition directions from the right and left frames 11*a*, 11*b* between the belt fixing rod 12 and the pinching resilient portion 13. A difference in the female member of this modification resides in that the right and left protruded pieces 14*a*, 14*b* are connected via a rod member 14*c*. The rod member 14*c* is in a form of a recess in the rear side with steps with respect to the right and left protruded pieces 14*a*, 14*b*. With this rod member 14*c*, the entire rigidity of the female member 10 increases and it becomes hard to disengage from the mating male member 20.

In the male member 20 shown in FIG. 11, a difference from the embodiment of FIG. 7 resides in that the taper step portions 24*d* of the right and left legs 24*b*, 24*c* are formed to be curved faces 24*e* curving smoothly to project outwardly. With the curved faces 24*e*, when the flange 25 is brought in contact with the frame lid of the mating female member 10 to be engaged, the right and left legs 24*b*, 24*c* are smoothly inserted into the guide space 13*c* while sliding along the frame 11*d*.

Hereinabove, representative embodiments of the present invention have been described. Obviously, the embodiments, but various modifications and design change are possible without departing from the technical matters described in the attached claims.

What is claimed is:

1. A belt connecting device composed of a female member and a male member which can engage with and disengage from each other, said female member having an annular body and having a belt connecting portion at one end thereof and an engaged/disengaged portion for engaging with and disengaging from the male member at the middle of the other end thereof, said male member having a plate shaped body and having a belt connecting portion at one end thereof and an engaging/disengaging portion for engaging with and disengaging from the engaged/disengaged portion of said female member at a middle portion thereof, wherein the engaged/disengaged portion of said female member comprises a substantially U-shaped pinching resilient portion open at the belt connecting portion and extending substantially on one same plane from said other end;

the engaging/disengaging portion of said male member comprises a protruded portion projecting substantially from a rear side middle portion of said plate shaped body and at least the belt connecting portion side end face portion thereof having a configuration to be circumscribed by a pinching surface of said pinching resilient portion of the female member, and a substantially C-shaped attachment flange having a rear face of which engages with a surface attachment face of said pinching resilient portion at an upper end of said protruded portion; and said attachment flange has a projection amount gradually increasing from said protruded portion in a direction toward said belt connecting portion of the male member.

2. The belt connecting device according to claim 1, wherein said pinching resilient portion comprises a guide space for said engaging/disengaging portion, enlarged gradually toward the belt connecting portion side, and an arc shaped pinching space adjacent to said guide space.

3. The belt connecting device according to claim 2, wherein the protruded portion of said male member has a substantially U-shape opening toward an end opposite to said belt connecting portion in a plan view, an end at the side of the belt connecting portion has an arc shape outer surface fitting with said pinching space, and comprises legs extending to a side away from the belt connecting portion, and a projection height of said legs at least at a connecting portion with said flange has the same height as a top face of the flange.

4. The belt connecting device according to claim 1, wherein a pair of respective resilient legs extending to the belt connecting portion side of said pinching resilient portion have long holes extending longitudinally in middle portions thereof.

5. The belt connecting device according to claim 4, wherein top faces of said resilient legs have a plane extending in parallel to a rear side of the annular body toward the belt connecting portion, and a taper face inclined downward toward a tip end adjacent to said plane.

6. The belt connecting device according to claim 1, wherein the thickness of a part of the belt connecting portion of said male member or female member is increased to an engaging/disengaging face side substantially by an entire thickness of the other member mating therewith.

* * * * *